United States Patent [19]

Rosso

[11] Patent Number: 4,509,666

[45] Date of Patent: Apr. 9, 1985

[54] STOCKING TURNING DEVICE

[75] Inventor: Pietro Rosso, Turin, Italy

[73] Assignee: Rosso Industrie S.p.A., Orbassano, Italy

[21] Appl. No.: 598,942

[22] Filed: Apr. 11, 1984

[30] Foreign Application Priority Data

Apr. 11, 1983 [IT] Italy ..... 67394 A/83

[51] Int. Cl.[3] ..... D05B 21/00

[52] U.S. Cl. ..... 223/39; 223/40; 223/42; 112/262.2

[58] Field of Search ..... 223/39, 40, 41, 42, 223/43; 112/262.2

[56] References Cited

U.S. PATENT DOCUMENTS

| | | | |
|---|---|---|---|
| 1,030,336 | 6/1912 | Shields | 223/39 |
| 1,898,824 | 2/1933 | Forstall | 223/39 |
| 2,340,420 | 2/1944 | Newman | 223/40 |
| 2,702,544 | 2/1955 | Hanington | 223/40 X |
| 3,429,284 | 2/1969 | Bryan | 112/262.2 X |
| 3,467,289 | 9/1969 | Preston | 223/40 |
| 3,516,583 | 6/1970 | Petty | 223/39 |
| 4,364,320 | 12/1982 | Nakhle et al. | 112/262.2 |
| 4,440,329 | 4/1984 | Hodges | 223/43 |
| 4,460,111 | 7/1984 | Nakahira | 223/43 |

FOREIGN PATENT DOCUMENTS

| | | | |
|---|---|---|---|
| 83521 | 4/1895 | Fed. Rep. of Germany . | |
| 46881 | 10/1979 | Italy . | |
| 1345376 | 1/1974 | United Kingdom | 223/39 |
| 639981 | 10/1977 | U.S.S.R. | 223/39 |

*Primary Examiner*—Louis K. Rimrodt

*Attorney, Agent, or Firm*—Sughrue, Mion, Zinn, Macpeak, and Seas

[57] ABSTRACT

A stocking turning device comprises a pair of belts (9, 10) of a lower pair, which grip the toe of a previously-sewn stocking having an indent or pocket at its closed end, and fit it on to a flat bar or batten (6) disposed vertically. The belts (11, 12) of an upper pair stop immediately the free edge of the stocking top is no longer grasped by the lower pair of belts.

22 Claims, 14 Drawing Figures

STOCKING TURNING DEVICE

Figure 1:
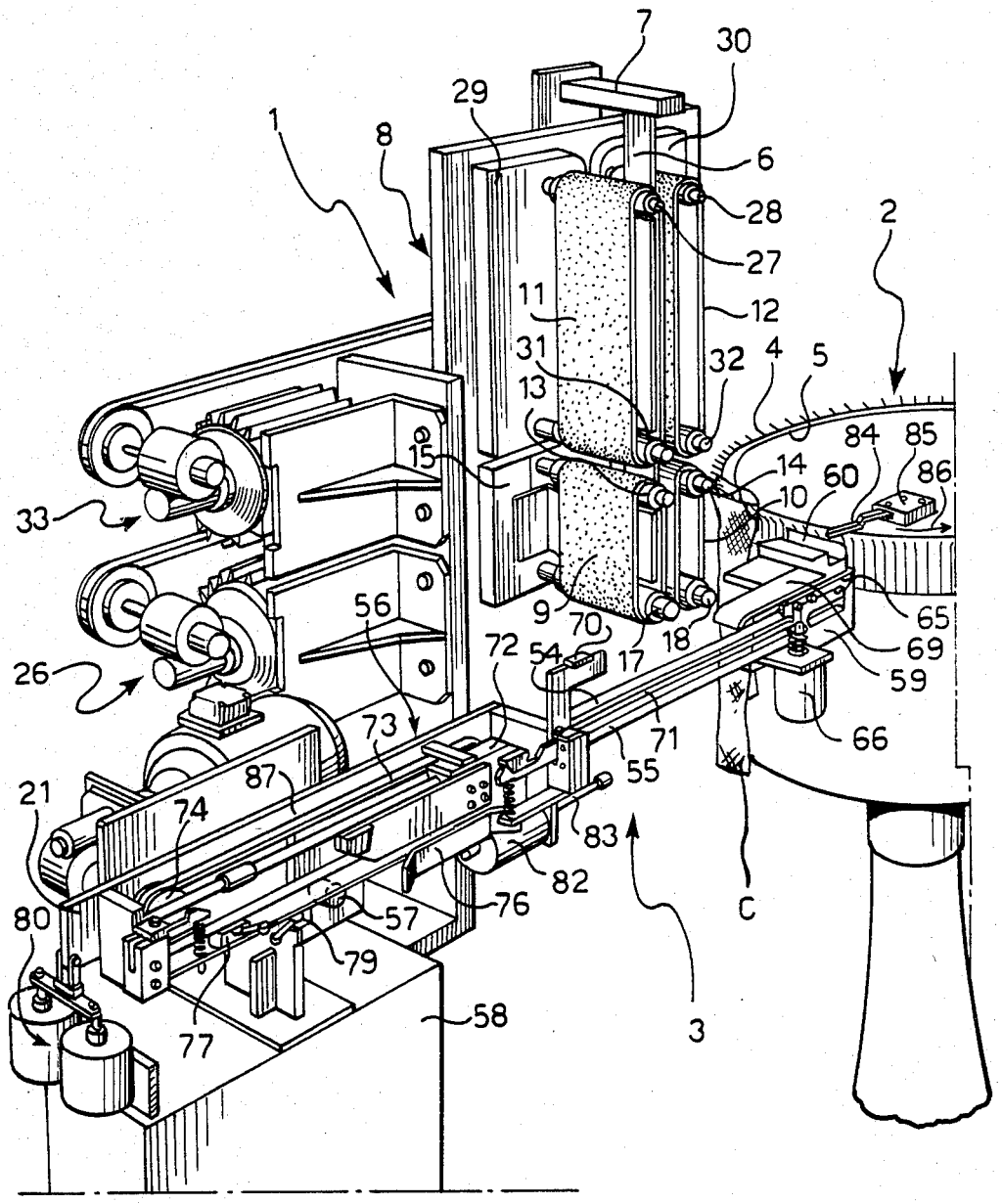

The present invention relates to a stocking turning device and in particular to a device of this type arranged to be used in combination with a linking machine.

A stocking turning device is already known which has a flat bar on which the tubular textile of a stocking, closed by sewing, is fitted and simultaneously turned inside out, starting from the toe, under the action of a pair of contra-rotating rollers resiliently pressed against the opposite faces of the flat bar.

In one embodiment of this device, the rollers rotate about substantially stationary axes during the fitting of the stocking on to the flat bar and the bar is advanced towards the open end of the textile of the stocking.

In another embodiment, the flat bar remains stationary and the assembly of contra-rotating rollers is moved along the flat bar, causing, by the combined action of their rotation in opposite senses and the movement of their axes along the flat bar, the fitting of the stocking on to the bar and the simultaneous turning of the stocking itself inside out.

In both cases, at the end of the fitting operation, the rollers are moved away from the flat bar against the action of the said resilient means to allow the removal of the turned stocking from the flat bar.

The known devices of the type specified above have several disadvantages. The first lies in the fact that contact between a stocking fitted on to the flat bar and the rollers resiliently pressed against the latter, takes place almost exclusively along a generatrix of each roller. This necessitates relative movement between the roller assembly and the flat bar thus complicating the drive mechanisms which operate the device. A further disadvantage lies in the fact that at the end of the fitting and simultaneous turning of a stocking, the rollers must be moved away from the flat bar to allow the removal of the turned stocking from the latter.

Moreover, the cycle of fitting the stocking on to the bar may start only after the flat bar and the rollers associated therewith have been returned to their starting position relative to each other.

The object of the present invention is to provide a stocking turning device which is free from these disadvantages and which also has means for effecting the automatic transfer of a stocking already sewn from the needles of the rotatable ring of a linking machine, to the inlet of the stocking turning device proper, this transfer being synchronised with the operation of the device.

According to the invention, the first of these objects is achieved by the provision of a stocking turning device of the type having a fixed flat bar and members which are resiliently pressed against the opposite faces of the bar, said members being arranged to grasp the tubular textile portion of a stocking close to the previously-sewn stocking toe when this toe is held against the free end of the flat bar, and being arranged to fit the tubular textile progressively on to the flat bar, simultaneously turning it inside out, which is characterised in that the flat bar is sandwiched between closely-fitting passes of identical endless belts which pass around pulleys rotatable about axes the positions of which are at fixed levels relative to the flat bar, the passes belonging to at least one pair of drive belts located on opposite sides of the said flat bar symmetrically relative thereto.

According to a preferred embodiment of the invention, the flat bar is sandwiched between the closely fitting passes of two pairs of endless belts, the belts of each pair being identical. The belt passes which closely fit the flat bar and belong to the pair closest to the free end of the flat bar, are shorter than those of the pair closest to the other end of the flat bar.

A further preferred characteristic of the invention lies in the fact that the belts are driven so as to effect, during the turning of the stocking, a sequence of operations which includes:

(a) for both pairs of belts, advance of the passes closely fitting the flat bar in a direction away from the free end of the flat bar, (b) cessation of the movement of the belts of the pair furthest from the free end of the flat bar immediately the edge of the stocking top disengages the belts of the said pair, and a simultaneous reversal of the movement of the belts of the pair closest to the free end of the flat bar, (c) cessation of the movement of the belts of the pair closest to the free end of the flat bar immediately the stocking is completely removed from the flat bar itself.

According to a further preferred characteristic of the invention, the device includes an automatic feeder comprising a take-up member controlled by a mechanism, co-ordinated with the operation of the motors which drive the belts, in such a manner that the take-up member is operative to take up stockings already sewn by the needles of the linking machine, then to place the stockings beneath the free end of the flat bar in a position in which the belts of the leading group can grasp the toes of the stockings, and finally to start the operating cycle which, after the return of the take-up member to its starting position, results in turning of the stockings so manipulated.

Figure 2:
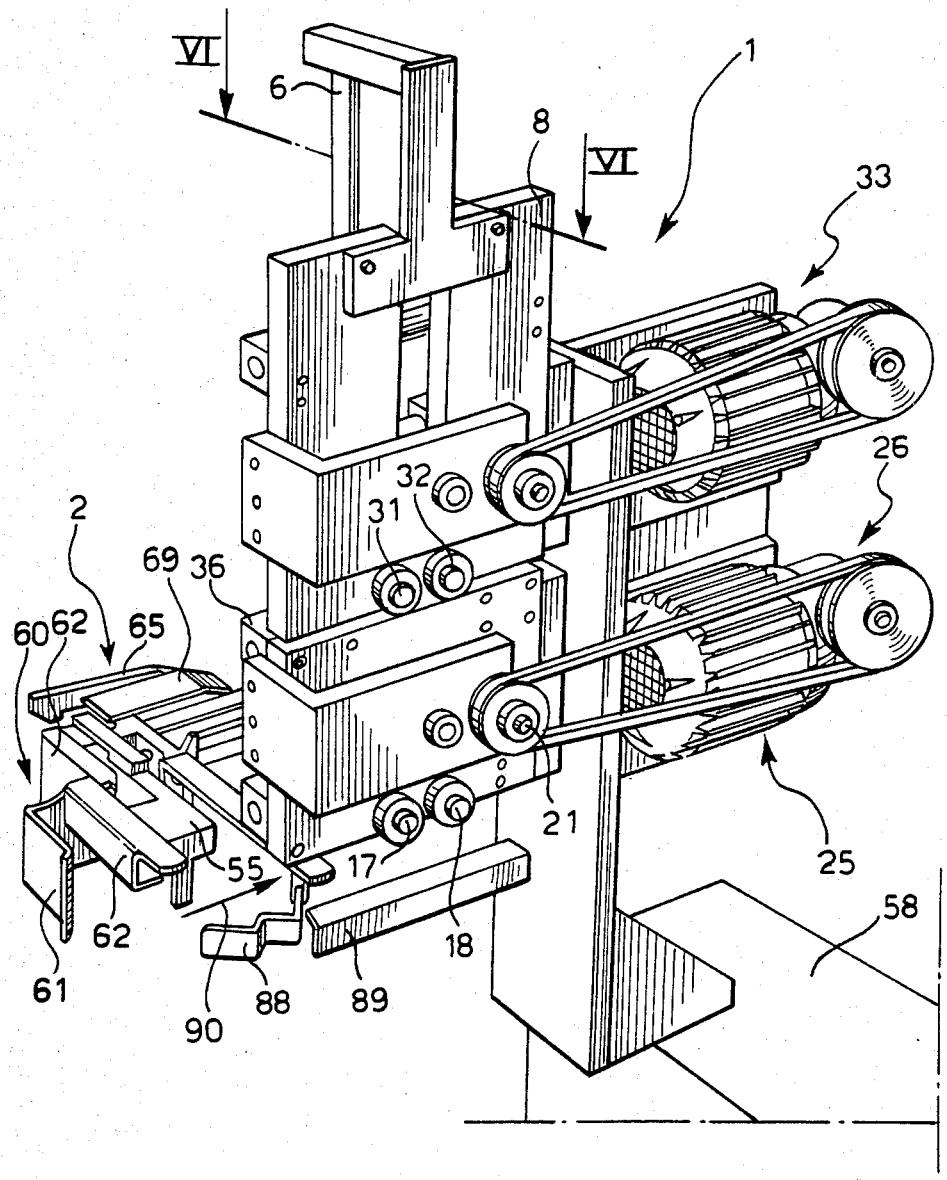
Figure 3:
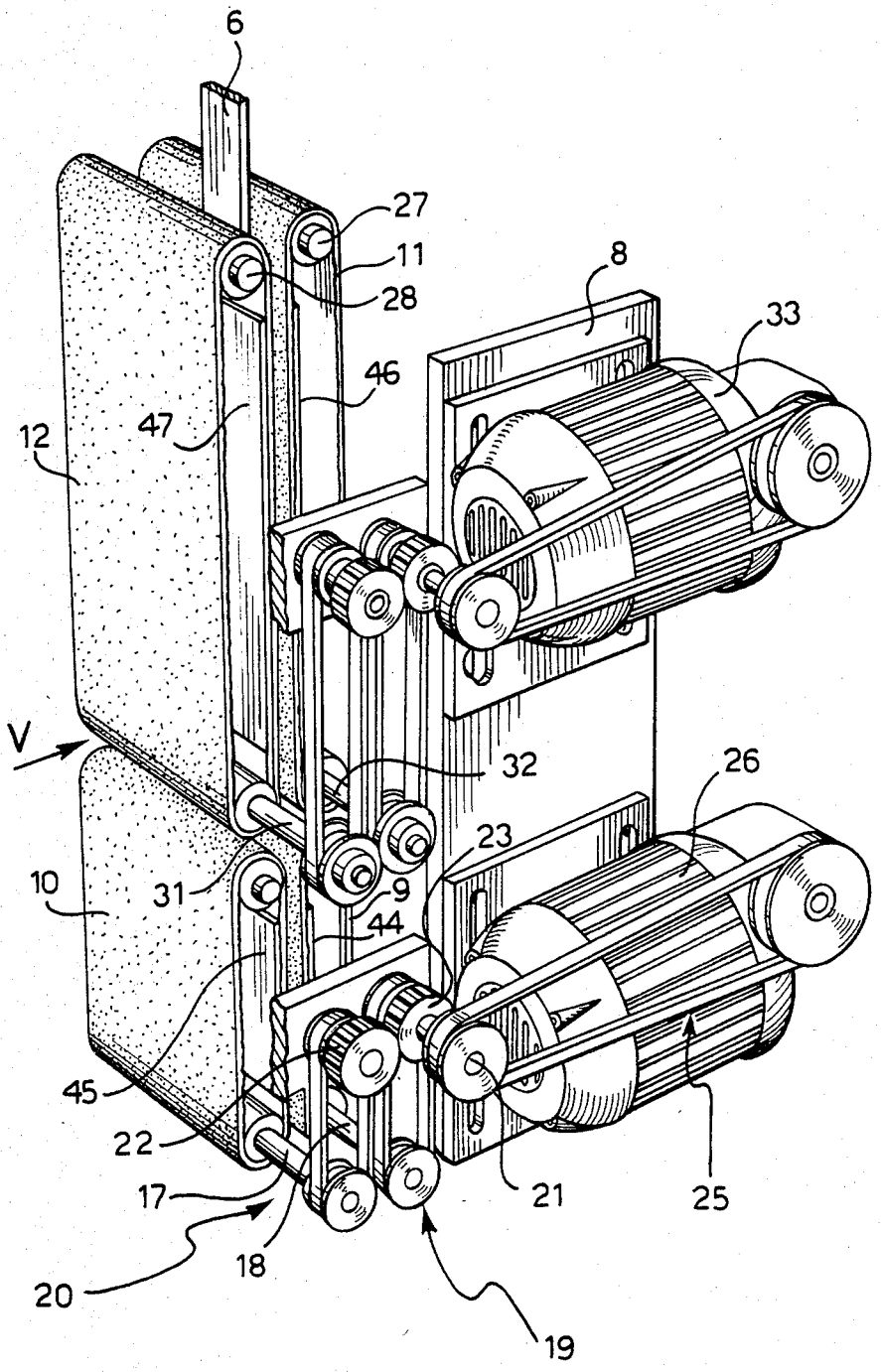
Figure 4:
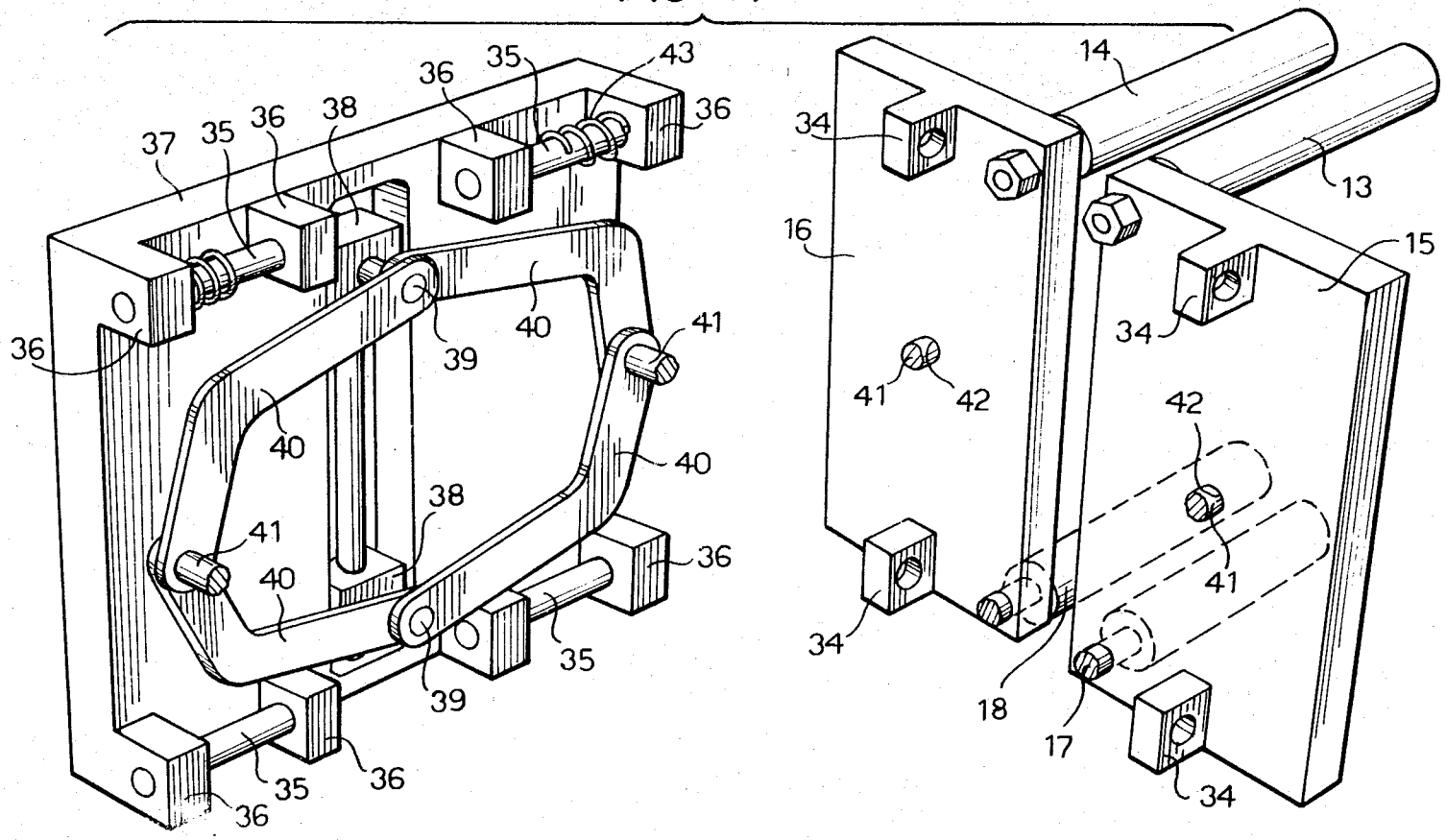
Figure 5:
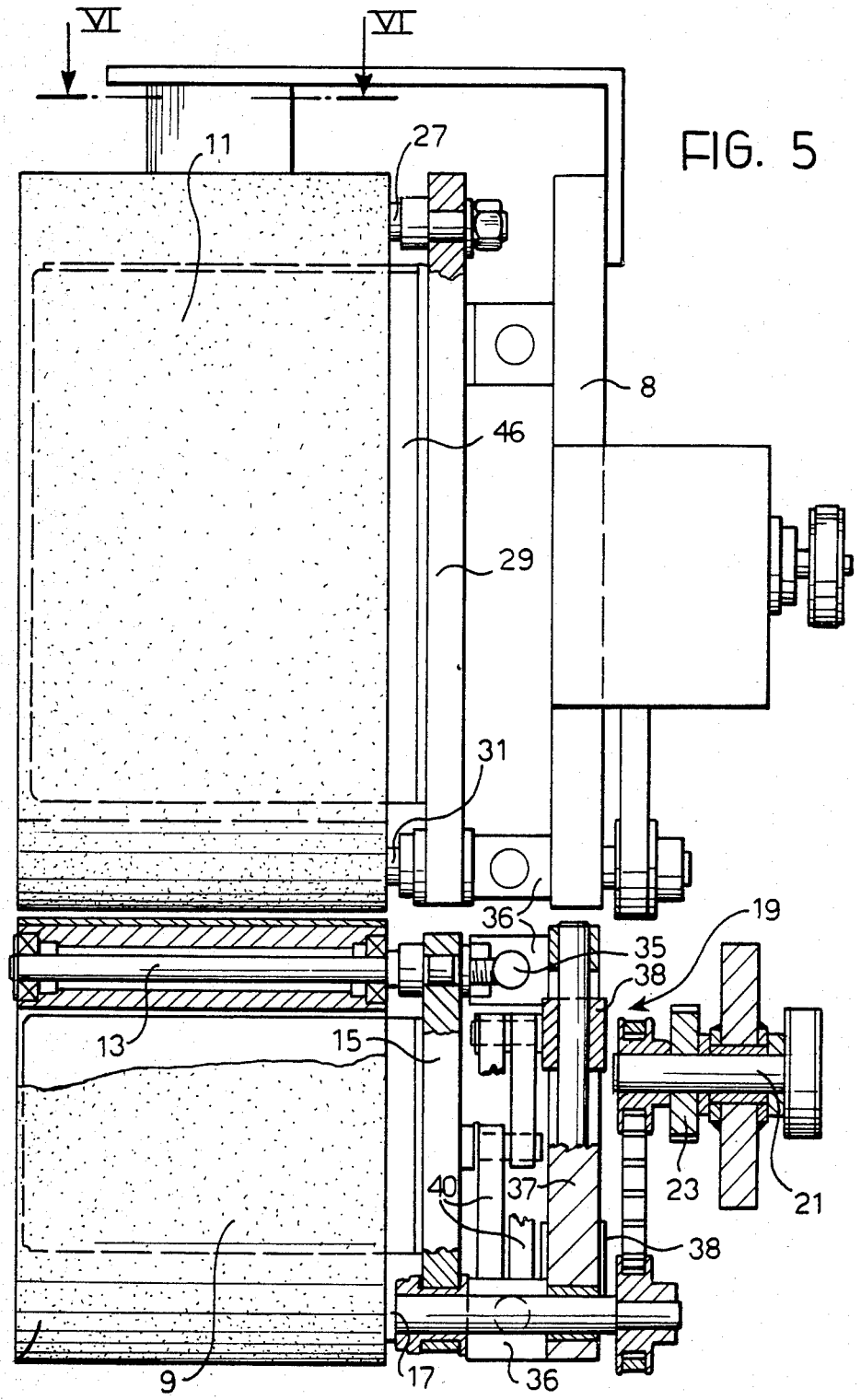
Figure 6:
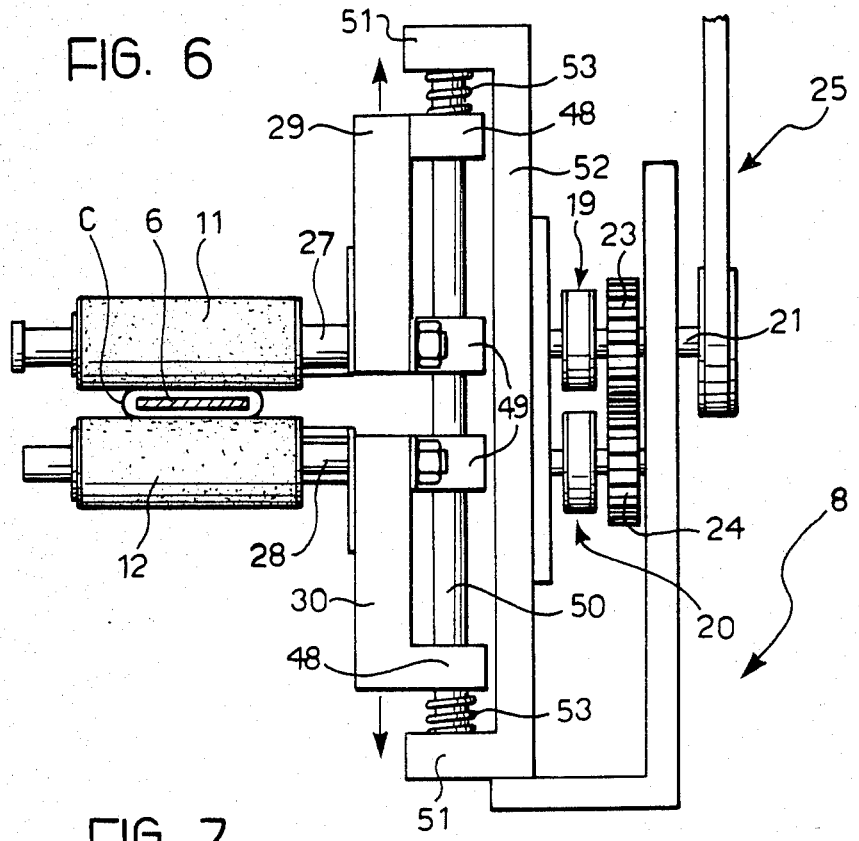
Figure 7:
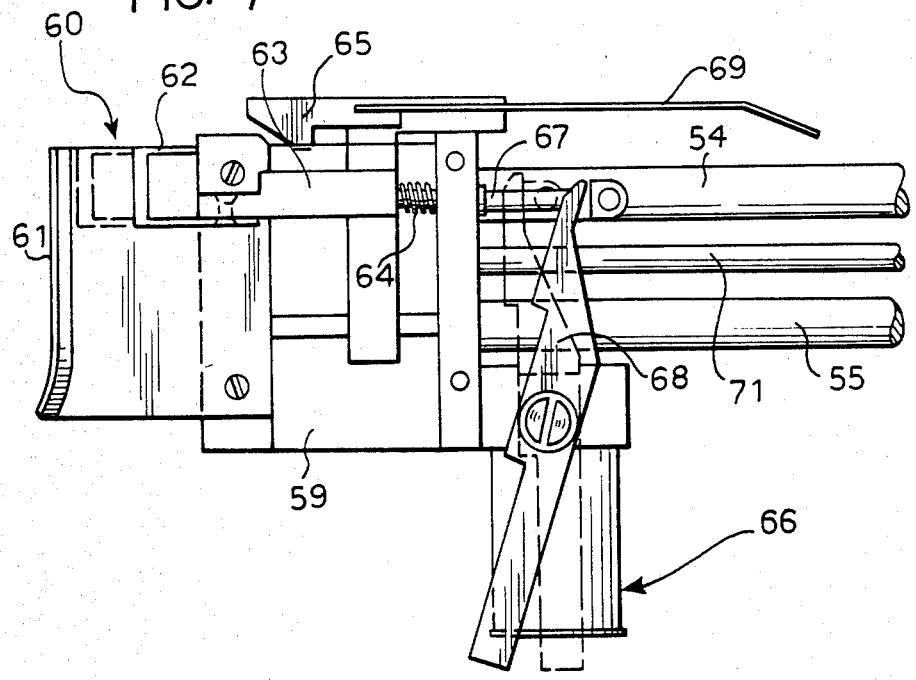
Figure 8:
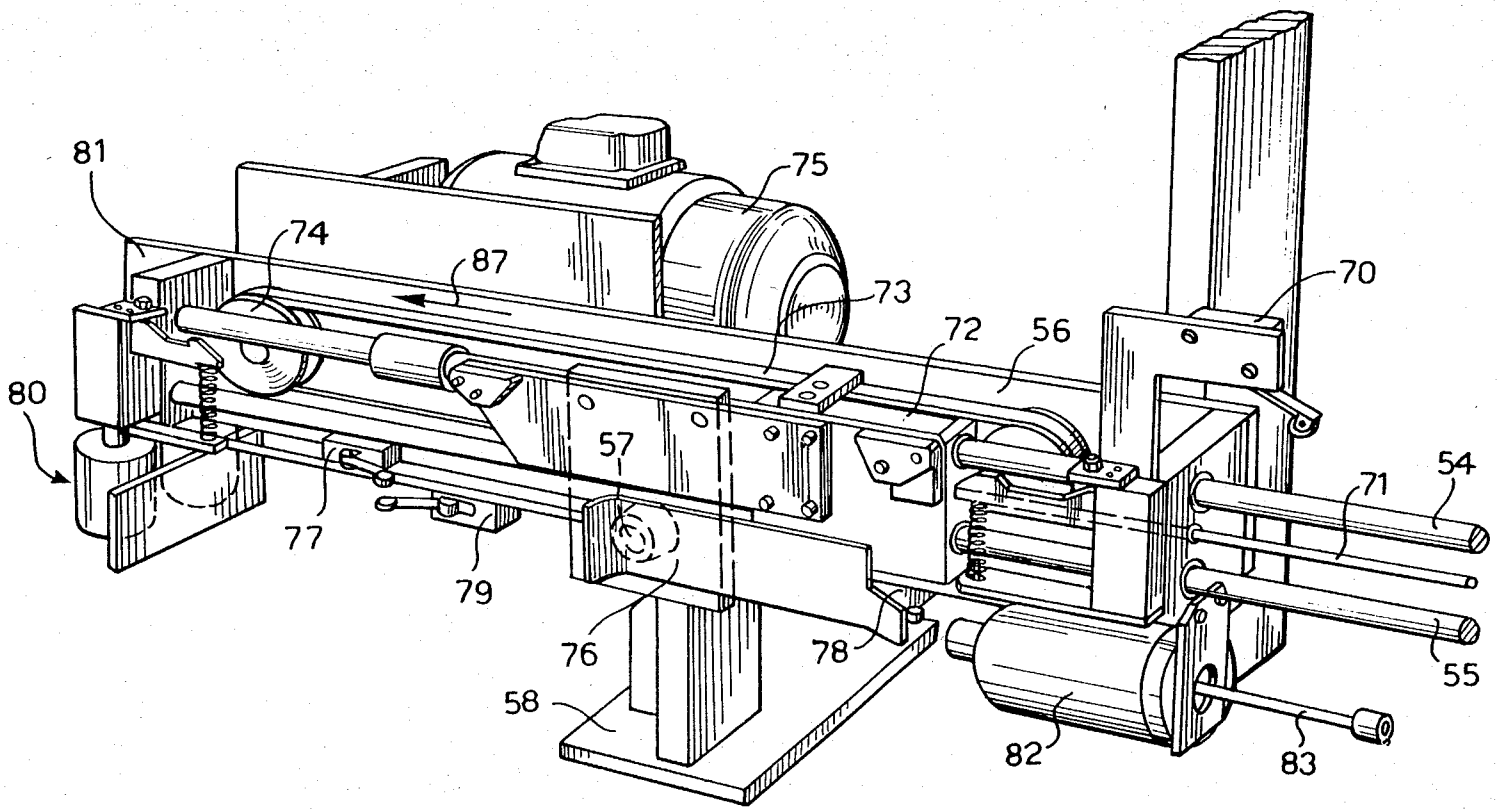

Other characteristics and advantages of the invention will become apparent from the description which follows by way of non-limiting example with reference to a practical embodiment illustrated in the appended drawings, in which:

FIG. 1 is a front perspective view of the stocking turning device according to the invention and of the related feeder associated with a linking machine, FIG. 2 is a rear perspective view of the same device and of a part of the feeder, FIG. 3 is a schematic perspective view of the transmissions which drive the belts, FIG. 4 is an exploded perspective view, on an enlarged scale, showing several details of the support arrangement for the belts of the pairs closest to the free end of the flat bar, FIG. 5 is a partially-sectioned view taken in the direction of arrow V of FIG. 3, FIG. 6 is a section taken on line VI—VI of FIG. 5, FIG. 7 is a side view showing the slide with the fork in an open position, FIG. 8 is a perspective view showing, on an enlarged scale, several details of the structure shown in FIG. 1, and FIGS. 9 to 14 are schematic sections taken on a median plane perpendicular to the oppositely facing vertical faces of the flat bar, showing the sequence of operations which result in the turning of a stocking under the action of two pairs of endless belts adjacent the opposite faces of the flat bar.

In the drawings (see in particular FIG. 1) reference 1 generally indicates the stocking turning device, reference 2 the linking machine, and reference 3 a feeder which is arranged to take up already-sewn stockings that are suspended close to their respective toes from the needles 4 of the rotatable ring 5 of the linking machine.

The stocking turning device includes a vertical flat bar 6 the upper end of which is fixed to a cross member 7 that projects from a fixed support structure generally indicated 8. Starting from its free lower end, this flat bar is sandwiched between the endless belts of the two pairs of belts 9 and 10, and 11 and 12 respectively, the belts of each pair being identical. The length of the belts 9 and 10 of the lower pair closer to the free end of the flat bar 6, is about half that of the belts 11 and 12 of the upper pair further from the free end of the flat bar. All these belts are internally toothed and are driven by sprockets having external toothing. The sprockets driving the belts 9 and 10 of the lower pair are carried by short horizontal upper shafts 13 and 14 respectively that project from plates 15 and 16 respectively and are freely rotatably mounted in these plates. The lower sprockets are keyed to respective shafts 17 and 18 which have their axes lying in the vertical planes containing the horizontal shafts 13 and 14 respectively and which also project from the plates 15 and 16. The shafts 17 and 18 are rotatably mounted in these plates and extend out through the opposite sides of these latter. The shafts 17 and 18 are driven via belt and pulley transmissions 19 and 20 respectively (see FIG. 3) from respective shafts 21 and 22 which are interconnected by gears 23 and 24 respectively associated therewith. The shaft 21 is driven via a belt and pulley transmission 25 from a geared motor 26. The transmission ratio between the gears 23 and 24 is chosen such that the linear velocity of the belt 9 is slightly greater than that of the belt 10.

The sprockets driving the belts 11 and 12 of the upper pair furthest from the free end of the flat bar 6, are keyed to respective ones of a pair of upper horizontal shafts 27 and 28 that project from respective vertical plates 29 and 30, positioned above the plates 15 and 16, and are freely rotatably mounted in these plates. The lower sprockets for driving the belts 11 and 12 are keyed to horizontal shafts 31 and 32 respectively that project from the plates 29 and 30 and are rotatably mounted therein. The axes of the shafts 27 and 31 lie in the vertical plane containing the axes of the shafts 13 and 17 and the axes of the shafts 28 and 32 lie in the vertical plane containing the axes of the shafts, 14 and 18. The shafts 31 and 32 pass through the plates 29 and 30 and are driven by a transmission (see FIG. 3), identical to that which drives the shafts 17 and 18, from the geared motor 33 which is also carried by the fixed support structure 8. The plates 15 and 16, and the plates 29 and 30 are mounted so as to be movable in a horizontal direction perpendicular to the vertical plane containing the flat bar 6 and are continuously urged by spring means towards this plane.

The plates 15 and 16 are slidably mounted (see FIGS. 4 and 5) by means of respective pairs of apertured rear projections 34, on horizontal pins 35 carried by brackets 36 which project towards the plates 15 and 16, from a plate 37 that is a part of the fixed support structure 8. A vertical recess is formed in the middle of the plate 37 and opens out in the side of the plate 37 towards the plates 15 and 16. Slidably mounted within this recess are small spaced-apart blocks 38 each of which carries a pin 39 that projects, perpendicular to the plate 37, towards the plane of the plates 15 and 16. The ends of a pair of cranked levers 40 are articulated on these pins, the other ends of the lever being articulated together on either side of the median vertical transverse plane of the plate 37, and being provided with pins 41. These latter engage in holes 42 formed in the plates 15 and 16 in their zones intermediate their respective pairs of projections 34 and equidistant from these projections. Springs 43 interposed between the projections 34 of the plates 15 and 16 and the outer brackets 36 of the plate 37, continuously urge the plates 15 and 16 towards the median vertical plane of the plate 37, this plane being coincident with the vertical plane in which the flat bar 6 is disposed.

Thus the passes of the belts 9, 10, 11 and 12 closest to the flat bar 6 are held constantly in close contact with the flat bar. In order to ensure that the said passes are always vertical, vertical guide plates 44 and 45 for the belts 9 and 10 respectively and 46 and 47 for the belts 11 and 12 respectively, are located on the sides of the passes away from the flat bar 6. These plates are carried by the plates 15 and 16 and the plates 29 and 30 respectively and are perpendicular thereto.

Each of the plates 29 and 30 in which the shafts 27, 28, 31 and 32 carrying the drive sprockets for the belts 11 and 12 of the upper pair are mounted, is provided at its lower end with a respective pair of apertured rear projections 48 and 49 (see FIG. 6) which are spaced apart and slidably engage a horizontal guide bar 50. The ends of the latter are fixed to lateral vertical flanges 51 of a fixed plate 52 coplanar with the plate 37 and also forming part of the fixed structure 8. Helical springs 53 interposed between the flanges 51 and the projections 48 of the plates 29 and 30 continuously urge the latter towards the vertical plane in which the flat bar 6 lies.

The feeder comprises a pair of normally horizontal guides constituted by normally horizontal bars 54 and 55 (see FIGS. 1, 7 and 8) the axes of which lie in a vertical plane perpendicular to the plane of the flat bar 6 and located slightly outside the belt assembly 9 to 12. These bars are supported by a U-frame 56 which is rotatably mounted about an axis 57 with respect to a base 58 that also carries the said fixed support structure 8. The bars 54 and 55 extend towards the linking machine 2 and are both located at a level beneath the plane in which the associated rotatable ring 5 lies.

A slide 59 (see FIGS. 1 and 7) is slidable on the part of the guides 54 and 55 lying between the U-frame 56 and the linking machine 2, and carries, on its side facing the linking machine 2, a forked structure generally indicated 60. The forked structure extends perpendicular to the vertical plane containing the axes of the bars 54 and 55 and is open towards the plane containing the plates 15 and 16, and the plates 29 and 30. This fork comprises an outer jaw 61 rigid with the slide 59 and an inner jaw 62 movable relative to the first. The movable jaw 62 is fixed to a slider 63 which is slidable in the slide 59 in a direction parallel to the guide bars 54 and 55 and which is continuously urged, jointly with the movable jaw 62, towards the outer jaw 61 by a spring 64. The jaw 62 is normally held spaced from the jaw 61 by virtue of the retention of the slider 63, against the action of the spring 64, in a withdrawn position, by the hooked end of a rocker arm 65, which is rotatable about a horizontal axis perpendicular to the plane containing the axes of the guide bars 54 and 55, and has its other end articulated to the core of an electromagnet 66 (see FIG. 1) carried by the slide 59. The spring 64 which urges the slider towards the jaw 61 is wound about a rod 67 that is slidable in a through hole formed in a transverse rib of the slide 59 and projects from this rib towards the U-frame 56. The rod 67 has an enlarged end engaged by the fork-shaped end portion of a rocker arm 68 that is pivotable about an axis perpendicular to the plane containing the axes of the guide bars 54 and 55, and projects below these axes. The slide 59 carries thereabove a cam plate 69 arranged to cooperate with a microswitch 70 (see FIGS. 1 and 8) the activation of which operates a timing circuit (not illustrated) arranged to control the operation of the geared motors 26 and 33 which drive the belts 9 to 12.

The slide 59 is fixed to a bar 71 which is parallel to the guides 54 and 55 and extends into the U-frame 56.

The end of the bar located within this frame is connected, by means of a carriage 72 which is slidable along the U-frame 56, to the upper pass of an endless belt 73 circulating on pulleys, one of which 74 is located close to the end portion of the U-frame 56 opposite the slide 59 and is driven by a geared motor 75 carried by the frame 56. The carriage 72 carries a side cam 76 arranged to cooperate with stroke-limit microswitches 77 and 78 respectively (see FIG. 8). Beneath the microswitch 77 is a further microswitch 79 which is arranged to supply current to electromagnets 80. The cores of the latter are connected by an articulated joint to a rear projection 81 of the U-frame 56. The frame 56 carries therebeneath a further, horizontal-axis electromagnet 82 the core of which is extended towards the linking machine 2 by a rod 83 arranged to advance when the electromagnet is energised to act on the lower free end of the rocker arm 68 (FIG. 7) in order to displace this lever from its position illustrated in FIG. 7 in broken outline to its position illustrated in continuous outline in FIG. 7.

The slide 59 is normally in its position illustrated in FIG. 1—in which the fork 60 is open by virtue of the withdrawal of the associated movable jaw 62 away from the jaw 61—beneath the plane in which the needles 4 of the rotatable ring 5 of the linking machine slide.

Using the described structure, the following sequence of operations is effected in order to take up and turn automatically stockings that have been closed by sewing on a linking machine.

The stocking C suspended from the needles 4 of the rotatable ring 5 of the linking machine 2 enters the fork 60 underlying the plane in which the needles move and, at a certain point, rotates in the direction of arrow 86 the operating arm 84 (see FIG. 1) of a microswitch 85 located on the platform of the linking machine. The actuation of the microswitch 85 causes energisation of the electromagnet 66 carried by the slide 59 and rotation of the rocker arm 65 in the anticlockwise sense (in FIG. 1) whereby the hook end of this arm is disengaged from the slider 63. This results in the slider moving under the action of the spring 64 towards the jaw 61 of the fork and the stocking being gripped between the jaw 61 and the movable jaw 62 which now takes up the position illustrated in FIG. 7 in broken outline.

Actuation of the microswitch 85 causes, after a short delay, operation of the geared motor 75 to advance the upper pass of the belt 73 in the direction of the arrow 87. The effect of this is to displace the slide 59, by means of the bar 71, towards the U-frame 56. Before the termination of the withdrawal of the slide 59 from the ring 5—and the simultaneous withdrawal of the fork 60 which causes the disengagement of the stocking C from the needles 4—the cam 69 carried by the slide 59 engages the microswitch 70 closing the latter and thereby starting the timing cycle for the movements of the belts 9 to 12 between which the flat bar 6 is disposed. During this movement the lateral mouth of the fork 60 is also closed by the shaped lever 88 which engages a bar 89 attached to the fixed structure 8 when the slide 59 moves in the direction of the arrow 90.

The withdrawal movement of the slide 59 moves the side cam 76 fixed to the carriage 72 into engagement with the operating lever of the stroke-limit microswitch 77 thereby causing stoppage of the geared motor 75. This stoppage occurs when the fork 60 carrying the stocking gripped between its jaws 61 and 62, is positioned beneath the lower end of the flat bar 6. At this point the simultaneous operation of the microswitch 79 energises the electromagnets 80 which cause the guides 54 and 55 and the U-frame 56 to pivot about the axis 57 in an anticlockwise sense (FIG. 1) so as to raise the fork 60 towards the lower end of the flat bar 6 and the lower mouth of the belts 9 and 10. The closure of the microswitch 79 also causes energisation of the electromagnet 82 the core of which, via the rod 83, pushes against the lower end of the rocker arm 68 causing the latter to rotate in a clockwise sense (in FIG. 7). This has the effect of moving the slider 63 against the action of the spring 64 and opening the fork by virtue of the simultaneous withdrawal of the movable jaw 62 away from the jaw 61.

The stocking is thus free to be drawn upwardly, starting from its toe which is juxtaposed to the lower end of the flat bar 6, by the belts 9 and 10 of the lower pair, the fork meanwhile remaining open by virtue of the engagement of the slider 63 by the hook of the rocker arm 64; this arm is no longer subject to the action of the electromagnet 66 as the latter has in the meantime been de-energised, so that the arm can return again to a position in which it is located below the path of the needles 4 of the ring 5.

The electromagnets 80 operate only for a time sufficient for the stocking C to be grasped by the belts 9 and 10 of the lower pair. Thereafter, the electromagnets 80 are automatically de-energised and the guides returned to their horizontal starting position.

The switch operated by the stroke-limit microswitch 77 is timed so as to start automatically the return of the slide 59 towards the ring 5 of the linking machine by re-activating the geared motor 75, on this occasion rotating in the opposite sense from that described above. The movement of the slide 59 towards the ring 5 leaves the position free for a stocking which has already been turned—by the action of the assembly including the flat bar 6 and the pairs of belts 9 and 10, and 11 and 12 respectively—to fall into a container (not illustrated) beneath the flat bar.

The return stroke of the slide 59 and fork 60 is halted when the stroke-limit microswitch 78 is actuated.

At this point the feeding cycle may be started again.

The manner in which the stocking is, in the meantime, turned inside out will be explained with reference to FIGS. 9 to 14.

At the end of the raising of the slide 59 under the action of the electromagnets 80, the pocket formed at the closed toe of the stocking is brought to bear against the lower end of the flat bar 6.

The belts 9 and 10, advancing in the directions illustrated by the arrows, grasp the tubular textile of the stocking and fit it on to the flat bar 6 and move it upwardly. The outer layer of the tubular textile is caused to slide over the inner layer which is retained against upward movement by the flat bar 6, the textile being fitted, and simultaneously turned, on to the portion of the flat bar 6 disposed between the belts 9 and 10 (FIG. 10) assisted finally by the belts 11 and 12 (FIG. 11).

Figures 9, 10, 11, 12, 13, 14:
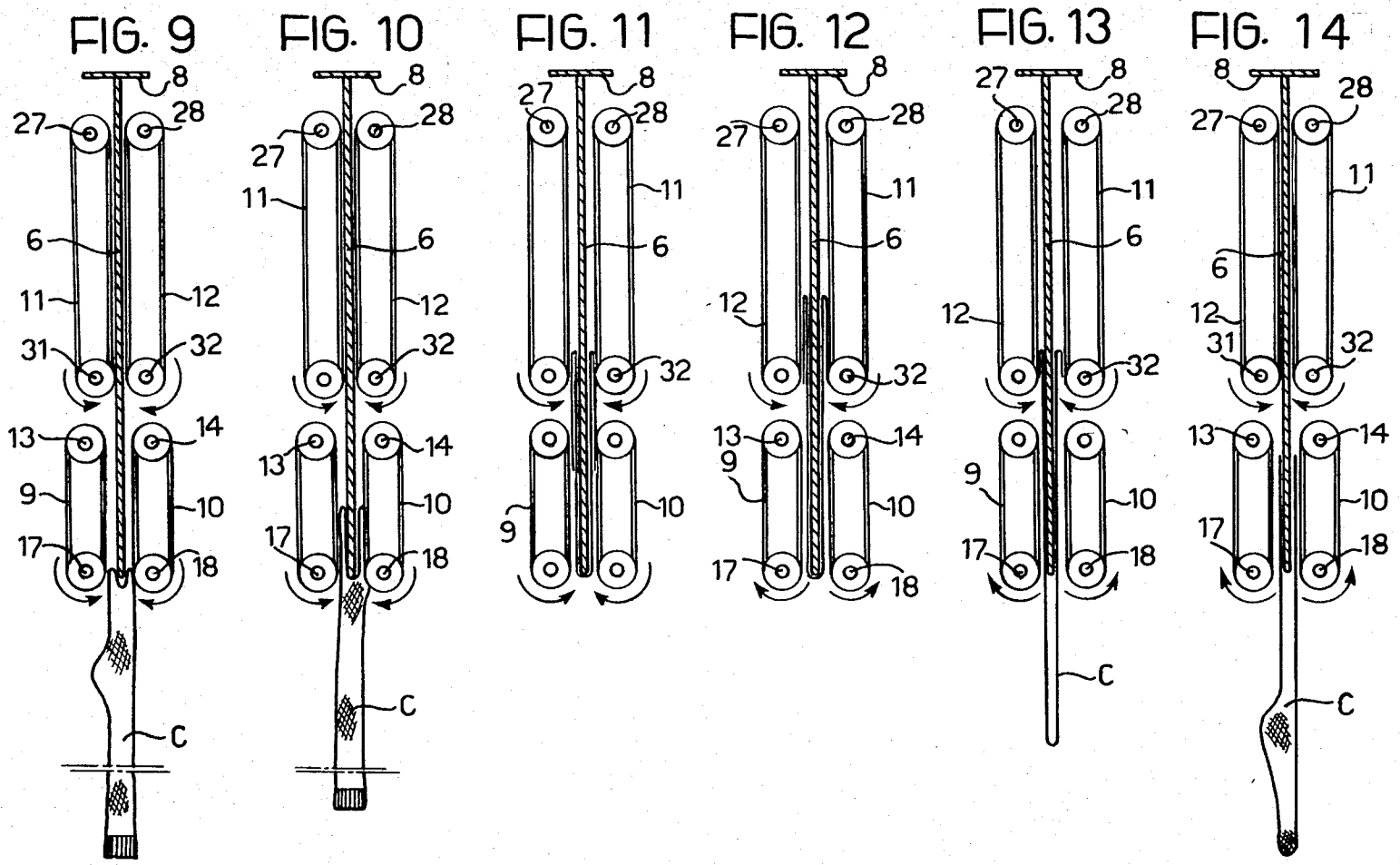

When the free edge of the stocking top is in the position illustrated in FIG. 12, the geared motor 33 is stopped by the action of the timer and simultaneously the direction of movement of the belts 9 and 10 is reversed. Consequently, the stocking already turned by the flat bar 6 is removed automatically downwardly and it falls freely into the underlying container. At this point the belts 9 and 10 are also stopped and the assembly is stopped to await the next stocking to be turned.

Naturally, the principle of the invention remaining the same, its embodiments may be varied widely with respect to that described and illustrated above purely by way of example, without thereby departing from the scope of the invention defined in the appended claims.

Thus for example the feeder could be used, and possible adapted, to take up stockings with the toe already sewn from a sewing machine of a different type from a conventional linking machine, possibly from a sewing machine in which the stockings are transported through the sewing zone by devices without needles which engage the textile of the stockings themselves.

According to a further modification of the embodiment disclosed with reference to the drawings, the closure and the opening of the forked structure 60, the displacements of the slide 59 so as the rotations of the U-shaped frame 56 about the axis 57 can be obtained by the action of suitably controlled fluid operated cylinders, such as double acting pneumatic cylinders, thereby dispensing from the use of the electromagnets 66 and 80 and even of the third motor 75.

I claim:

1. A stocking turning device of the type having a fixed flat bar and members which are resiliently pressed against the opposite faces of the flat bar, said members being arranged to grasp the tubular textile portion of a stocking close to the previously-sewn toe when this toe is held against the free end of the flat bar, and being arranged to fit the tubular textile progressively on to the flat bar, simultaneously turning it inside out, wherein the improvement comprises at least one pair of endless drive belts identical in each pair disposed on opposite side of the said flat bar symmetrically relative thereto, said belts each passing around pulleys rotatable about axes the positions of which are at fixed levels relative to the flat bar and sandwiching the said bar between their passes closely fitting the above mentioned bar.

2. A device as claimed in claim 1, wherein the flat bar is sandwiched between the closely-fitting passes of two pairs of endless belts, the belts making up each pair being identical to each other.

3. A device as claimed in claim 2, wherein the belt passes which fit closely to the flat bar belonging to the pair closest to the free end of the flat bar are shorter than those of the pair closest to the other end of the flat bar.

4. A device as claimed in claim 3, wherein the length of the passes which closely fit the flat bar and belong to the first of the pairs of belts, is about half that of the corresponding passes of the belts belonging to the other pair.

5. A device as claimed in claim 2 wherein, during turning of the stocking, the belts are driven so as to effect the following sequence of operations:

(a)—advancement of the passes of both pairs of belts that closely fit the flat bar in a direction away from the free end of the flat bar, (b)—cessation of the movement of the belts of the pair furthest from the free end of the flat bar immediately the top edge of the stocking disengages the belts of the said pair; and a simultaneous reversal of the movement of the belts of the pair closest to the free end of the flat bar, (c)—cessation of the movement of the belts of the pair closest to the free end of the flat bar immediately the stocking is completely removed from the flat bar itself.

6. A device as claimed in claim 2, wherein it includes two timer-controlled motors each of which is arranged to control the movement of the belts of one of the belt pairs between which the flat bar is located.

7. A device as claimed in claim 6, wherein each of the belts of each pair located on one side of the flat bar passes over two rollers at different heights, the horizontal axes of these rollers extending parallel to the flat bar itself, and the rollers projecting from plates slidable in a direction perpendicular to the vertical plane containing the flat, resilient means, being further provided for urging said plates towards this plane.

8. A device as claimed in claim 7, wherein each of the plates carries a vertical strip located close to the face of the pass of each of the belts adjacent the flat bar.

9. A device as claimed in claim 2, wherein one of the said belts belonging to the pair closest to the free end of the flat bar is arranged to be driven such that, during the operation of the device, it operates at a speed of advance greater than that of the other belt.

10. A device as claimed in claim 1, wherein the flat bar is disposed vertically with its free end facing downwardly.

11. A device as claimed in claim 10, including an automatic feeder comprising a take-up member controlled by a mechanism, coordinated with the operation of the motors which drive the belts, in such a manner that the take-up member is operative to take-up stockings already sewn by the needles of a linking machine, then to place the stockings beneath the free end of the flat bar in a position in which the belts of the leading group can grasp the toes of the stockings, and finally to start the operating cycle which, after the return of the take-up member to its starting position, results in turning of the stockings so manipulated.

12. A device as claimed in claim 11, wherein the take-up member is in the form of a fork normally located beneath the needles in the zone into which the toe of a stocking which has been sewn is to be brought, and in that said mechanism comprises means arranged to transfer this fork automatically to a position in which the toe of the stocking can be grasped by the belts of the pair closest to the free end of the flat bar, and to return the fork to its initial position.

13. A device as claimed in claim 11, wherein the guides on which the slide is slidable are rotatably mounted about a horizontal axis which is perpendicular to the longitudinal direction of the guides and is located on the side of the flat bar away from the ring of the linking machine; and wherein the device further includes means for rotating the guides about the said axis in a direction such as to raise the slide carrying the fork, when the latter is beneath the free end of the flat bar, in response to the closure of a microswitch which takes place when the slide reaches the end of its movement away from the said ring.

14. A device as claimed in claim 13, wherein a bar fixed to the slide, moves the latter along the guides by the end of the bar opposite that fixed to the slide being connected to one of the passes of an endless belt arranged to circulate around pulleys one of which is driven by means of a reduction gear from a third electric motor that is fixed to the assembly including the guides.

15. A device as claimed in claim 14, wherein a lateral cam carried by the bar fixed to the slide is arranged to act on microswitches which determine the opposite end-of-stroke positions of the slide and, thus of the take-up fork.

16. A device as claimed in claim 11, wherein the fork is carried by a slide slidable on normally-horizontal guides which are parallel to the vertical plane perpendicular to the flat bar, and wherein it includes: a sensor arranged to sense the presence of the stocking within the take-up fork, and a third motor arranged to move the slide from the position in which the fork is located beneath the ring of needles to the position in which the toe of the stocking held by the fork can be grasped by the belts of the pair closest to the free end of the flat bar, and arranged to return the slide to its starting position immediately after the toe of the stocking is taken up by the belts.

17. A device as claimed in claim 16, wherein the take-up fork includes an outer jaw, closer to the ring, which is fixed to the slide and an inner jaw, closer to the flat bar, which is rigid with a slider carried by the slide and includes resilient means interposed between the slider and its supporting slide urging it continuously towards the above mentioned ring.

18. A device as claimed in claim 17, wherein it further includes means for closing the normally open entrance of the fork immediately after the latter has been moved from the position in which it is arranged to receive a sewn stocking suspended from the needles with which the ring of the linking machine is provided.

19. A device as claimed in claim 18, wherein the said means include a lever rotatable about a vertical axis and carried at the end of a support element rigid with the slide; the lever being shaped and normally held by spring means in a position such as to leave open the entrance to the fork when the latter is beneath the needles of the ring of the linking machine, and cam means extending along the guides on which said slide is slidable, and arranged to rotate the lever towards the entrance of the fork to close the latter immediately after the commencement of sliding motion of the slide towards the zone in which the flat bar is disposed between the belts.

20. A device as claimed in claim 17, wherein the slider is held by the hooked end of a rocker arm pivotable about a horizontal axis transverse the slide, the other end of the rocker arm being connected by a tie rod to the core of a first normally de-energised electromagnet; this electromagnet being energised, with the resultant disengagement of the slider from the hooked end, in response to the activation of the sensor arranged to sense the presence of a stocking within the fork.

21. A device as claimed in claim 17, wherein the slide, on its side away from the linking machine, carries a vertical rocker arm which terminates at its upper end in a fork arranged to force back the slider against the action of the spring that urges it towards the ring of the linking machine, the end portion of the lower part of the vertical rocker arm being located in front of the end of a horizontal push rod connected to the core of a second, normally de-energised, horizontal-axis electromagnet which is energised when the slide is in its position in which the fork is disposed beneath the lower free end of the flat bar.

22. A device as claimed in claim 21, wherein the slide carries a cam arranged to act on the lever of a microswitch arranged to close the supply circuit of the second electromagnet.

* * * * *